United States Patent [19]

Saleh et al.

[11] 4,434,016

[45] Feb. 28, 1984

[54] PRECIPITATION HARDENABLE COPPER ALLOY AND PROCESS

[75] Inventors: Yousef Saleh, West Haven; John F. Breedis, Trumbull; Jacob Crane, Woodbridge, all of Conn.

[73] Assignee: Olin Corporation, New Haven, Conn.

[21] Appl. No.: 467,697

[22] Filed: Feb. 18, 1983

[51] Int. Cl.[3] ..... C22C 9/01; C22C 9/06; C22F 1/08

[52] U.S. Cl. ..... 148/12.7 C; 420/486

[58] Field of Search ..... 420/486; 148/11.5 C, 148/12.7 C, 419

[56] References Cited

U.S. PATENT DOCUMENTS

| | | | |
|---|---|---|---|
| 1,906,567 | 5/1933 | Fritschle | 420/479 |
| 2,061,897 | 11/1936 | Crampton et al. | 148/433 |
| 2,074,604 | 3/1937 | Bolton et al. | 420/487 |
| 2,101,930 | 12/1937 | Davis et al. | 420/479 |
| 2,144,279 | 1/1939 | Whitman | 420/471 |
| 2,236,975 | 4/1941 | Muller et al. | 420/522 |
| 2,430,419 | 11/1947 | Edens | 420/486 |
| 2,458,688 | 1/1949 | Davis | 420/485 |
| 2,772,963 | 12/1956 | Pease et al. | 420/487 |
| 2,851,353 | 9/1958 | Roach et al. | 420/486 |
| 3,769,005 | 10/1973 | Richardson et al. | 420/486 |
| 3,772,092 | 11/1973 | Shapiro et al. | 148/12.7 C |
| 3,772,093 | 11/1973 | Shapiro et al. | 148/12.7 C |
| 3,772,094 | 11/1973 | Shapiro et al. | 148/12.7 C |
| 3,772,095 | 11/1973 | Shapiro et al. | 148/12.7 C |
| 3,824,135 | 7/1974 | Pryor et al. | 148/12.7 C |
| 4,016,010 | 4/1977 | Caron et al. | 148/12.7 C |
| 4,052,204 | 10/1977 | Plewes | 148/160 |
| 4,073,667 | 2/1978 | Caron et al. | 148/12.7 C |
| 4,090,890 | 5/1978 | Plewes | 148/12.7 C |
| 4,233,068 | 11/1980 | Smith, Jr. et al. | 148/11.5 C |
| 4,233,069 | 11/1980 | Smith, Jr. et al. | 148/11.5 C |

FOREIGN PATENT DOCUMENTS

| | | |
|---|---|---|
| 655931 | 1/1938 | Fed. Rep. of Germany . |
| 852453 | 10/1952 | Fed. Rep. of Germany . |
| 2309077 | 10/1974 | Fed. Rep. of Germany . |
| 2351185 | 12/1977 | France . |
| 53-41096 | 10/1978 | Japan . |

OTHER PUBLICATIONS

"Copper Rich Ni-Al-Cu Alloys", Part 1, The Effect of Heat Treatment on Hardness and Electrical Resistivity, by W. O. Alexander and D. Hanson, *J. Inst. of Metals* 61 (1937) 83.

"Copper Rich Ni-Al-Cu Alloys", Part 2, The Constitution of the Cu-Ni Rich Alloys, by W. O. Alexander. Ibid, 63 (1938) 163.

"Copper Rich Ni-Cu Alloy", Part 3, The Effect of Heat Treatment on Microstructure, by W. O. Alexander.
Ibid, 64 (1939) 217.

*Primary Examiner*—Peter K. Skiff

*Attorney, Agent, or Firm*—Paul Weinstein; Howard M. Cohn; Barry L. Kelmachter

[57] ABSTRACT

An improved copper base alloy for use in electrical springs and a process of treating the alloy provide improved resistance to stress relaxation when the alloy is in a solution treated and aged condition having a discontinuous precipitate. The alloy consists essentially of from about 10% to about 15% nickel, from about 1% to about 3% aluminum, up to about 1% manganese, from about 0.05% to less than about 0.5% magnesium and the balance copper. The alloy is readily hot workable if held within a critical temperature range of from about 880° C. to about 980° C. prior to hot working.

15 Claims, No Drawings

PRECIPITATION HARDENABLE COPPER ALLOY AND PROCESS

Copper alloys used in electrical springs are generally optimized for strength, formability, resistance to stress relaxation and electrical conductivity. Stress relaxation resistance is a measure of the alloys ability to maintain high contact forces. It is also desired that such alloys be available in a mill hardened condition providing the required properties without requiring heat treatment of parts after a forming operation. In accordance with this invention a precipitation hardenable copper alloy containing nickel and aluminum and also containing critical amounts of magnesium is adapted to fulfill these requirements.

It is known that copper base alloys containing nickel and aluminum can be precipitation hardened as described in "Copper Rich Ni-Al-Cu Alloys", Part 1, "The Effect of Heat Treatment on Hardness and Electrical Resistivity", by W. O. Alexander and D. Hanson, *J. Inst. of Metals* 61 (1937) 83; "Copper Rich Ni-Al-Cu Alloys", Part 2, The Constitution of the Cu-Ni Rich Alloys, by W. O. Alexander, ibid, 63 (1938) 163; and "Copper Rich Ni-Al-Cu Alloy", Part 3, The Effect of Heat Treatment on Microstructure, by W. O. Alexander, ibid, 64 (1939) 217.

U.S. Pat. No. 2,851,353 to Roach et al. describes copper-nickel-aluminum-silicon alloys for spring purposes. The broad compositional ranges comprise from 5 to 15% nickel, 0.1 to 2.0% silicon, 0.1 to 6.0% aluminum and/or 0.1 to 2.0% magnesium, the balance copper. Roach et al. also teach solution treating such alloys at a temperature of from 1600° F. to about 1850° F. followed by againg at a temperature of from 700° F. to about 1000° F. U.S. Pat. No. 2,458,688 to Davis discloses improved welding parts comprised of a copper-nickel base alloy containing 10 to 35% nickel and from 0.02 to 0.1% magnesium. The alloys can also contain small amounts of manganese, namely 0.02% up to as high as 1.5%, iron from 0.05% to as high as 2% and fractional percentages of other elements usually as impurities, such as silicon, tin, phosphorous, etc. German Pat. No. 852,453 to Winder et al. discloses precipitation hardenable alloys containing 15 to 40% nickel, 0.5 to 4.5% aluminum, 0.1 to 2% chromium and the balance copper. The alloy may also contain manganese, magnesium, iron, silicon, cobalt or zinc, each in a range up to 5%. Numerous other patents disclose a variety of copper-nickel alloys with one or more further additions as, for example, U.S. Pat. Nos. 1,906,567, 2,061,897, 2,074,604, 2,101,930, 2,144,279, 2,236,975, 2,430,419, 2,772,963, German Pat. No. 655,931, German ALS 2,309,077 and Japanese Pat. No. 53-41096. The assignee of the present invention also owns a series of other patents relating to copper-nickel alloys containing large additions of manganese as well as other addition elements which can include magnesium such as U.S. Pat. Nos. 3,772,092, 3,772,093, 3,772,094, 3,772,095 and 3,824,135. Another copper-nickel-aluminum high manganese alloy is set forth in U.S. Pat. No. 3,769,005.

The assignee of the present invention also is the owner of patents relating to copper base alloys exhibiting spinodal precipitation which can include copper-nickel-aluminum alloys. Those patents comprise U.S. Pat. Nos. 4,016,010 and 4,073,667 to Caron et al. U.S. Pat. Nos. 4,052,204, 4,090,890 and French Pat. No. 7,714,260 relate to copper-nickel alloys exhibiting spinodal structures.

The aforenoted U.S. Pat. Nos. 4,016,010 and 4,073,667 describe that cooling from a solution heat treatment temperature at a controlled rate will result in spinodal decomposition providing a precipitate microstructure having higher aged strengths and better resistance to stress relaxation than that obtained in a water quenched and aged alloy. The microstructure developed by aging of the controlled, slowly cooled alloy can be referred to as a continuous type precipitation and consists of an array of fine, coherent precipitate particles of $Ni_3Al$ randomly distributed throughout the matrix phase of the alloy. Such controlled cooling causes a serious economic penalty since normal commercial equipment cannot provide the controlled cooling rates for large volumes of metal. On the other hand, the aged microstructure after rapid quenching from the solution heat treatment temperature consists of fine lamellae of $Ni_3Al$ and copper solid solution in discrete cells which advance from grain boundaries during aging. Such precipitation is known as the discontinuous type, and while it can generally provide better strength-to-bend properties relative to the continuous precipitation type the resistance to stress relaxation has been inferior.

U.S. Pat. Nos. 4,233,068 and 4,233,069 to Smith et al. relate to brass alloys with improved stress relaxation resistance which include magnesium additions. The alloys of the present invention comprising cupronickel alloys are readily distinguishable from the brass alloys of these patents.

In accordance with the present invention an alloy is provided having copper-nickel-aluminum-manganese within specific ranges and includes a critical magnesium addition. The alloys of this invention have improved resistance to stress relaxation when processed to provide discontinuous precipitation. The good strength-to-bend properties characteristic of discontinuous precipitation type alloys are retained and electrical conductivity is not reduced by the addition of magnesium. Further, an added benefit is that the oxide formed during a strip annealing operation is more easily removed by chemical means due to the presence of magnesium in the alloy. The alloy is essentially silicon free since silicon adversely affects the hot working of the alloy.

The alloy of this invention consists essentially of from about 10% to about 15% nickel, from about 1% to about 3% aluminum, up to about 1% manganese, from about 0.05% to less than about 0.5% magnesium and the balance copper. Silicon should not exceed about 0.05%, lead should be less than about 0.015%, zinc should be less than about 0.5% and phosphorous should be less than about 0.005%. Preferably, the alloy contains from about 11.5% to about 12.5% nickel, from about 1.8% to about 2.3% aluminum, from about 0.1% to about 0.3% magnesium, from about 0.2% to about 0.5% manganese and the balance copper. Preferably, silicon should not exceed about 0.005%. In a most preferred embodiment, the magnesium is further limited to a range of from about 0.15% to about 0.25%. All of the percentage compositions which have been set forth herein are percentages by weight. The alloy of this invention may include other elements which do not adversely affect its properties. However, preferably other elements are included at no more than impurity levels so that the balance of the alloy is essentially copper.

The lower limits for the nickel and aluminum contents are required for achieving adequate strength levels. The upper limits for the nickel and aluminum contents are imposed by the requirement that the alloy have good hot rolling performance. The lower limit for manganese is governed by the necessity of tying up any sulfur in the alloy which improves its hot rollability and its soundness. The upper limit for manganese is dictated by considerations of conductivity and the ability of the alloy to be soldered or brazed. Preferably, the conductivity of the alloy is greater than 10% IACS and, most preferably, greater than 11% IACS.

The alloys in accordance with this invention can be case in any desired manner, however, preferably the magnesium addition is made last and at least after the aluminum addition in order to maximize magnesium recovery in the cast ingot. The alloys can be hot worked as by hot rolling starting at a temperature of from about 880° to about 980° C. and, preferably, 950° to about 980° C. after holding at such a temperture for at least 30 minutes with at least 1½ hours total time in the furnace. The preheating temperature range before hot rolling is critical for this alloy. Preheating to a temperature below the ranges set forth or overheating the alloy to a temperature above the ranges set forth both result in cracking of the ingot on hot rolling and thereby reduce the alloy yield in subsequent processing.

Since the alloy is precipitation hardenable hot rolling should be done as quickly as possible followed by cooling rapidly to room temperature before the metal temperature reaches about 750° C. or near the alloy's solvus temperature. The alloys can then be cold worked as by cold rolling to a desired gage with at least 90% cold reduction being possible. The alloys may then be intermediate annealed by a bell or strip anneal at above about 750° C. before solution treating, if desired. This provides processing flexibility with respect to cold rolling the alloy to a desired gage.

The alloy may be solution heat treated by annealing at a metal temperature near or above the alloy solvus, preferably above about 750° C. followed by rapid cooling such as a water quench. The alloy may be cleaned and then is cold worked as by cold rolling to a finish gage with up to 75% reduction in thickness and then aged at a temperature of from about 400° to about 550° C. for from about 4 to about 24 hours. The alloy can then be cleaned. The cleaning can be carried out by the process described in U.S. Pat. No. 3,646,946 to Ford et al. For example, the alloys can be cleaned by sequential immersion in boiling 1N caustic solution followed by a warm (about 100° F.) 12% sulfuric acid solution containing 3% hydrogen peroxide.

EXAMPLES

Copper base alloys having a nominal composition of 12% nickel, 2% aluminum, 0.3% manganese with magnesium contents varying from 0 to 0.5% were cast using cathode copper, carbonyl nickel shot, high-purity aluminum, electrolytic manganese and high-purity magnesium. The alloys were processed except as otherwise noted in accordance with the processing previously described. Alternatively a labaoratory solution heat treatment was carried out by holding the alloys for 15 minutes at from about 800° to 850° C. followed by water quenching.

EXAMPLE I

The tensile properties of the copper base alloys having the aforenoted nominal composition are shown in Table I after aging of the alloys in strip form which were previously subjected to solution heat treatment and cold rolling as noted in the table. The abbreviation "CR" stands for cold rolling. The abbreviation "ksi" refers to thousands of pounds per square inch. The solution treatments employed with the alloys of Table I included rapid cooling from the solution heat treated temperature such as by water quenching in the laboratory (WQ) or water quenching after continuous strip annealing (SA) in the plant or slow cooling (SC) at 0.9° C. per second between 800° C. and 300° C.

The addition of magnesium to the alloy was found to result in an equiaxed grain structure after strip annealing (20 μm grain size); whereas, the alloy without magnesium did not appear to be completely recrystallized. The effect of this difference is illustrated by the higher aged strength as shown in Table I after strip annealing for the magnesium free alloy. The electrical conductivity values after strip annealing were about 8% for all the alloys with or without magnesium which shows that the constituent elements have been taken into solution. It, therefore, appears that magnesium facilitates recrystallization of the alloy.

The presence of magnesium did not alter the aging behavior of the alloy, that is, discontinuous precipitation developed during aging of all alloys containing magnesium after rapid quenching and cold rolling. discontinuous precipitation results in greater tensile elongation and lower tensile strength relative to the case of continuous precipitation regardless of magnesium content as shown by comparing the water quenched and slow cooling results, respectively, in Table I. However, the magnesium addition slightly increases the strength of the discontinuous precipitated alloy without detracting from tensile elongation. Finally, the aged electrical conductivities are virtually unchanged as the magnesium content of the alloy increases within the limits of this invention as illustrated in Table II.

TABLE I

Aged Tensile Properties of Cu—12% Ni—2% Al—0.3% Mn as Function of Mg Content

| Process | | Mg Content | Aged* Properties | | |
|---|---|---|---|---|---|
| Identification | Description | (Wt. pct.) | 0.2% Yield (ksi) | Tensile (ksi) | Elongation (% in 2") |
| SA | Plant Strip Anneal** + 50% CR + Age* | 0 | 128 | 140 | 10 |
| | | 0.06 | 113 | 132 | 12 |
| | | 0.11 | 114 | 134 | 14 |
| | | 0.14 | 120 | 136 | 10 |
| | | 0.28 | 119 | 138 | 12 |
| WQ | Lab Water Quench + 50% CR + Age* | 0 | 100 | 118 | 14 |
| | | 0.50 | 111 | 129 | 14 |

TABLE I-continued

Aged Tensile Properties of Cu—12% Ni—2% Al—0.3% Mn as Function of Mg Content

| Process | | Mg Content | Aged* Properties | | |
|---|---|---|---|---|---|
| Identification | Description | (Wt. pct.) | 0.2% Yield (ksi) | Tensile (ksi) | Elongation (% in 2") |
| SC | Lab Slow Cool*** + | | | | |
| | 25% CR + Age* | 0 | 132 | 135 | 3 |
| | 75% CR + Age* | 0 | 138 | 158 | 3 |

*400° C.-24 hours (Lab) or 500° C.-4 hours which are equivalent aging treatments
**830° C. furnace temperature.
***0.9° C./seconds.

TABLE II

Electrical Conductivities of Mg—Containing Cu—Ni—Al Alloys*

| Mg Content (Wt. pct.) | Aged Electrical Conductivity (% IACS) |
|---|---|
| 0 | 12.4 |
| 0.06 | 11.4 |
| 0.11 | 11.7 |
| 0.14 | 11.8 |
| 0.28 | 12.0 |

*Plant strip annealed + Cr(50%) + Aged (400° C.-24 hours).

EXAMPLE II

Alloys having essentially the same nominal compositions as in Example I were processed and tested to determine their resistance to stress relaxation at a temperature of 105° C. The measurements were made utilizing cantilever-type samples stressed initially at their outer fiber to 80% of their particular yield strengths. Typical results for the 105° C. tests are shown in Table III with the alloys in the conditions noted as previously explained in Example I. The results set forth in Table III clearly establish the criticality of magnesium within the ranges of this invention for improving the stress relaxation resistance of the alloys. Further, comparing the solution treated and quenched samples with the solution treated and slow cooled samples which would provide discontinuous precipitation or continuous precipitation, respectively, it is apparent that the magnesium addition essentially improves the stress relaxation resistance of the discontinuous precipitation alloy to the level of the continuous precipitation alloy thereby overcoming the deficiencies in prior art alloys related to stress relaxation resistance when treated to provide a discontinuous precipitation. Furthermore, for constant processing, resistance to stress relaxation increases rapidly at the low end of the aforenoted magnesium range so that with 0.11% magnesium the alloy achieves 90% of complete stability. Additional magnesium in the alloy continues to increase resistance to stress relaxation, however, at a slower rate. Thus, the magnesium modified alloy of this invention would exhibit excellent stability when used as a spring connector provided the magnesium content exceeded about 0.11%.

Resistance to stress relaxation of the alloys of this invention very nearly matches that of beryllium copper (Copper Alloy C17200) and is superior to that of silicon-tin bronzes such as Copper Alloy C65400. When compared at the same minimum bend radius, e.g. at 3t (bad way) orientation, the stress remaining at the $10^5$ hours' exposure at 105° C. would be 98% for Copper Alloy C17200, 78% for stabilized Copper Alloy C65400 and 60% for Copper Alloy C65400 in the as-rolled temperature. The term "3t (bad way) orientation" refers to a bend radius equal to three times the strip thickness and that the bend axis is parallel to the rolling direction.

TABLE III

Resistance to Stress Relaxation of Cu—12% Ni—2% Al—0.3% Mn as Function of Mg Content

| Process | % Mg (wt. pct.) | Stress Remaining After $10^5$ hours at 105° C. Percent** | Actual (ksi) |
|---|---|---|---|
| SA + 50% CR + Aged* | 0 | 68 | 70 |
| | 0.06 | 87 | 79 |
| | 0.11 | 91 | 83 |
| | 0.14 | 90 | 89 |
| | 0.28 | 96 | 91 |
| SC + 25% CR + Aged* | 0 | 98 | 98 |
| SC + 75% CR + Aged | 0 | 88 | 95 |

*400° C.-24 hours or 500° C.-4 hours which are equivalent aging treatments.
**Percent remaining of initial imposed stress (80% of yield strength).

EXAMPLE III

In order to compare the strength to bend properties of alloys of this invention and selected spring alloys, the alloys were processed as indicated in Table IV. The alloys had compositions as set forth in Table IV with the solution treatments being identified as in Example I. The minimum bend radius, wherein "R" is the bend radius and "t" is the strip thickness, was determined by the onset of pronounced surface rumpling or cracking. In a "good way" bend the bend axis is generally perpendicular to the strip rolling direction; whereas, in a "bad way" bend the bend axis is generally parallel to the strip rolling direction. the data set forth in Table IV shows that the bend formability of the magnesium modified alloys of this invention is good and is comparable to that of other spring alloys provided that the magnesium content does not reach 0.5%. Beyond 0.5% bend formability is markedly reduced while strength increases slightly. Thus, the strength to bend properties become less attractive.

TABLE IV

Comparison of Strength-to-Bend Properties for Mg—containing Cu—Ni—Al and Selected Spring Alloys

| Process I.D. | Alloy | 0.2% Yield Strength | Minimum Bend Radius (R/t) Good Way | Bad Way |
|---|---|---|---|---|
| SA | Cu—12 Ni—2 Al—0.3 Mn—0.11 Mg | | | |

TABLE IV-continued

Comparison of Strength-to-Bend Properties for Mg—containing Cu—Ni—Al and Selected Spring Alloys

| Process I.D. | Alloy | 0.2% Yield Strength | Minimum Bend Radius (R/t) Good Way | Bad Way |
|---|---|---|---|---|
| | (25% CR + Aged) | 101 | 2.6 | 2.6 |
| | (50% CR + Aged) | 114 | 3.1 | 3.1 |
| | Cu—12 Ni—2 Al—0.3 Mn—0.28 Mg | | | |
| | (25% CR + Aged) | 102 | 2.6 | 2.6 |
| | (50% CR + Aged) | 119 | 2.3 | 3.1 |
| WQ | Cu—12 Ni—2 Al—.3 Mn | | | |
| | (50% CR + Aged) | 100 | 1.6 | 2.1 |
| | Cu—12 Ni—2 Al—.3 Mn—.5 Mg | | | |
| | (50% CR + Aged) | 111 | 6.2 | 14.5 |
| | C654 (Rolled Temper) | 100 | 2.2 | 3.5 |
| | | 116 | 4.0 | 6.3 |
| | C727 (75% CR + Aged) | 132 | 2.7 | 5.4 |

EXAMPLE IV

The presence of aluminum in copper alloys results in the formation of a difficult to remove oxide after annealing which is strongly adherent and chemically resistant. It has surprisingly been found that the addition of magnesium in the alloys of this invention improves their cleanability after strip annealing. If the alloys are bell annealed, then the magnesium addition does not appear to have a signficant effect on cleanability.

The effect of magnesium additions upon the ease by which the oxide can be removed is summarized in Table V. The alloys set forth in Table V were processed as in the previous Example I through the solution treatment SA. They had the same nominal compositions with varying magnesium compositions as set forth in Table V. The alloys were cleaned by sequential immersion in boiling 1N caustic solution followed by warm 110° F. 12% sufuric acid solution containing 3% hydrogen peroxide. Solderability was determined using a bath of 60% tin-lead solder held at 230° C. and using a mildly activated rosin flux sold under the trademark ALPHA 611. Solderability ratings of 2–3 represent a clean alloy. Higher numbers indicate the presence of dewetting oxides. It is apparent from a consideration of Table V that improved cleaning is achieved when the magnesium content is at least about 0.11% for times up to 44 seconds. A clean alloy can be achieved with a preferred magnesium level of at least about 0.14%.

It is apparent from the foregoing description and examples that magnesium serves to improve the resistance to stress relaxation of alloys of this invention when aged to form a discontinuous precipitate. The magnesium addition must be present within the critically defined limits in the alloy for it to be readily processable by hot working. Sepcifically, the magnesium content should be less than 0.5% to ensure good hot rolability. The magnesium sholud exceed about 0.14% to facilitate cleaning or chemical removal of strip annealing oxides. The stress relaxation resistance improvement requires magnesium contents in excess of 0.06 to 0.1% but should not exceed 0.5% to avoid inferior strength to bend properties. Thus, the total magnesium ranges for the alloy comprise broadly 0.06 to 0.5% and, preferably, 0.1 to 0.3% and, most preferably, 0.15 to 0.25%.

TABLE V

Effect of Mg Content on Cleaning Response of Cu—12 Ni—2 Al—.3 Mn—X Mg after Strip Annealing

| % Mg (wt. pct.) | Immersion Time* (sec) | Solderability Class** |
|---|---|---|
| 0.06 | 44 | 5 |
| 0.11 | 44 | 4–5 |
| 0.14 | 30 | 3–4 |
| 0.25 | 30 | 2a |
| 0.28 | 44 | 3 |

*Time in each of the solutions: boiling 1N Sodium Hydroxide followed by 12% Sulfuric Acid + 3% Hydrogen Peroxide at 110° F.
**5 - Completely bare
4 - ≧50% dewetting and/or >10% bare areas
3 - <50% dewetting and/or <10% bare areas
2 - Uniform coating with <1% pinholes; 2a 0–5% dewetting.
1 - Complete coverage

EXAMPLE V

The effect of silicon on the processability of the alloys of this invention having a nominal composition of 12% nickel, 2% aluminum, 0.2% magnesium, 0.35% manganese has been determined. Additions of 0.062% or 0.12% or 0.30% silicon (analyzed composition values) were made to alloys having such a nominal composition and the hot rollabiltity of those alloys was compared to the silicon free alloy. All of the alloys were Durville cast and preheated together at 950° C. for 1½ hours total furnace time. They were then hot rolled in six passes from 1.75" to 0.4" thickness. The silicon free alloy in accordance with this invention exhibited no cracking at the completion of hot rolling. All of the silicon containing alloys echibited cracking on the broad face near edges and edge cracking increasing in frequency and depth of cracks with increasing silicon content. As a consequence, recovery of sound material remaining after hot rolling was reduced when silicon was present by about a 25% decrease in yield.

The patents and articles set forth in the this application are intended to be incorporated by reference herein.

It is apparent that there has been provided in accordance with this invention a precipitation hardenable copper alloy and process which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A hot workable copper base alloy having improved strss relaxation resistance when subjected to discontinuous precipitation, said alloy consisting essentially of from about 10% to about 15% by weight nickel, from about 1% to about 3% by weight aluminum, up to about 1% by weight manganese, from about 0.05% to less than about 0.5% by weight magnesium, less than about 0.05% by weight silicon and the balance copper.

2. An alloy as in claim 1 wherein said nickel is from about 11.5% to about 12.5%, wherein said aluminum is from about 1.8% to about 2.3%, wherein said magnesium is from about 0.1% to about 0.3% and wherein said manganese is from about 0.2% to about 0.5%.

3. An alloy as in claim 2 wherein said magnesium is from about 0.15% to about 0.25%.

4. An alloy as in claim 3 wherein lead should be less than about 0.015%, zinc should be less than about 0.5% by weight, and phosphorous should be less than about 0.005%.

5. An alloy as in claim 1 in the solution treated, quenched and aged condition, said alloy having a discontinuous type precipitate.

6. An alloy as in claim 1 having improved cleanability, said alloy being in the strip annealed condition.

7. A process for treating a copper base alloy consisting essentially of from about 10% to about 15% by weight nickel, from about 1% to about 3% by weight aluminum, up to about 1% by weight manganese, from about 0.05% to less than about 0.5% by weight magnesium, less than about 0.05% by weight silicon and the balance copper to provide improved stress relaxation resistance in the presence of a discontinuous type precipitate, said process comprising:

holding said alloy at a temperature of from about 880° C. to about 980° C.;

hot working said alloy;

immediately following said hot working rapidly cooling said alloy;

cold working said alloy up to a 90% reduction in thickness;

solution treating said alloy at a metal temperature near or above the solvus of said alloy;

cold working said alloy up to a 75% reduction in thickness; and aging said alloy at a temperature of from about 400° C. to about 550° C.

8. A process as in claim 7 wherein said alloy is held at said temperature of from about 880° C. to about 980° C. prior to hot working for at least 30 minutes with at least about 1½ hours total time in a furnace.

9. A process as in claim 8 wherein said temperature range is from about 950° C. to about 980° C.

10. A process as in claim 9 further including an intermediate anneal prior to said solution heat treatment step at a temperature above about 750° C. and further including an additional cold working step between said intermediate anneal and said solution heat treatment.

11. A process as in claim 9 wherein said alloy is aged for from about 4 to about 24 hours.

12. A process as in claim 9 wherein said anneals comprise strip anneals and wherein following each of said strip anneals, said alloy is cleaned by immersion in a boiling caustic solution followed by immersion in a sulfuric acid solution.

13. A process as in claim 7 wherein said nickel is from about 11.5% to about 12.5%, wherein said aluminum is from about 1.8 to about 2.3%, wherein said magnesium is from about 0.1% to about 0.3% and wherein said manganese is from about 0.2% to about 0.5%.

14. A process as in claim 13 wherein said magnesium is from about 0.15% to about 0.25%.

15. A process as in claim 14 wherein lead should be less than about 0.015%, zinc should be less than about 0.5% by weight, and phosphorous should be less than about 0.005%.

* * * * *